US005819818A

United States Patent [19]

Frawley

[11] Patent Number: 5,819,818

[45] **Date of Patent: *Oct. 13, 1998**

[54] FUEL SPILLAGE CONTROL DEVICE AND METHOD FOR USING SAME

[76] Inventor: Patrick Frawley, 8 Cedar Pl., Bronx, N.Y. 10465

[ * ] Notice: This patent issued on a continued prosecution application filed under 37 CFR 1.53(d), and is subject to the twenty year patent term provisions of 35 U.S.C. 154(a)(2).

[21] Appl. No.: 779,831

[22] Filed: Jan. 7, 1997

[51] Int. Cl.[6] ..... B65B 1/04; B65B 3/04

[52] U.S. Cl. ..... 141/95; 73/290 V

[58] Field of Search ..... 141/94–96, 392; 73/290 V, 290 R; 116/227, 264, 266; 381/67, 74, 122; 367/197, 198, 199; 340/621; 224/930

[56] References Cited

U.S. PATENT DOCUMENTS 4,083,387 4/1978 Stieber et al. ..... 141/95
4,411,267 10/1983 Heyman ..... 224/930
4,438,772 3/1984 Slavin ..... 381/67
4,523,465 6/1985 Fasching et al. ..... 73/290 V

FOREIGN PATENT DOCUMENTS 4100607 7/1992 Germany ..... 381/67

*Primary Examiner*—Steven O. Douglas

[57] ABSTRACT

A fuel spillage control device and method for using same for qualitatively determining the liquid level inside a fuel tank as it is being filled. The fuel spillage control device includes a microphone for generating an audio signal, an amplifier for amplifying the audio signal and a pair of ear phones for transducing the amplified audio signal. To qualitatively determine the liquid level inside the fuel tank, after a fill hose has been inserted into the fuel tank, an operator lowers the microphone into the fuel tank to a distance above the liquid level, a valve to the fill hose is opened, thereby filling the fuel tank, an audio signal generated by the microphone is amplified and the amplified audio signal is listened to by the operator for changes in pitch.

8 Claims, 3 Drawing Sheets

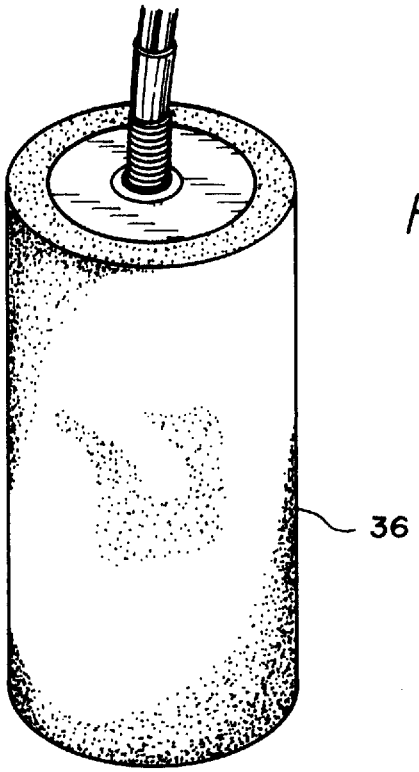
FIG. 5
FIG. 6
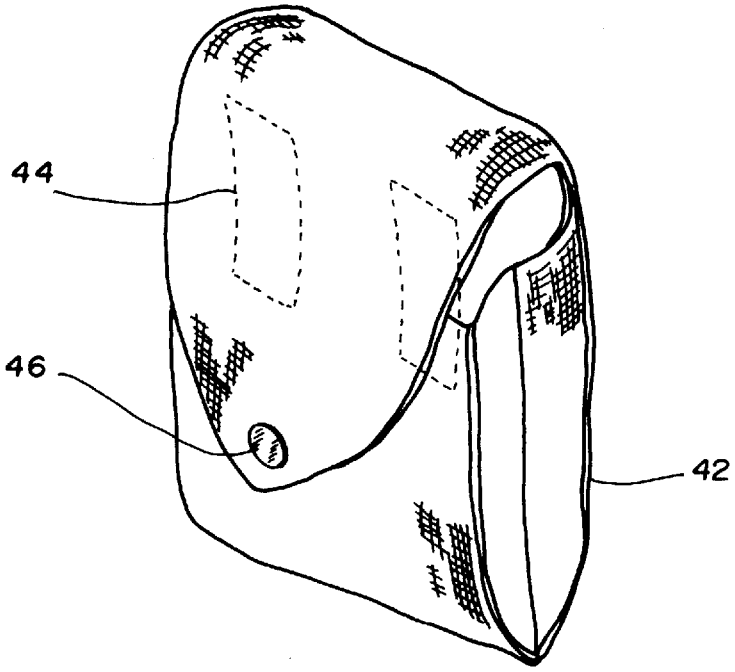

FUEL SPILLAGE CONTROL DEVICE AND METHOD FOR USING SAME

BACKGROUND OF THE INVENTION

1. Field of the Invention

The present invention relates to fuel spillage control devices and more particularly pertains to a new fuel spillage control device and method for using same for qualitatively determining the liquid level inside a fuel tank as it is being filled.

2. Description of the Prior Art

The use of fuel spillage control devices is known in the prior art. More specifically, fuel spillage control devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art fuel spillage control devices include U.S. Pat. No. 5,181,022; U.S. Pat. No. 4,854,469; U.S. Pat. No. 5,323,820; U.S. Pat. No. 5,023,608; and U.S. Pat. No. 4,083,387.

While these devices fulfill their respective, particular objectives and requirements, the aforementioned patents do not disclose a new fuel spillage control device and method for using same. The inventive device includes a microphone for generating an audio signal, an amplifier means for amplifying the audio signal and a pair of ear phones for transducing the amplified audio signal.

In these respects, the fuel spillage control device and method for using same according to the present invention substantially departs from the conventional concepts and designs of the prior art, and in so doing provides an apparatus primarily developed for the purpose of qualitatively determining the liquid level inside a fuel tank as it is being filled.

SUMMARY OF THE INVENTION

In view of the foregoing disadvantages inherent in the known types of fuel spillage control devices now present in the prior art, the present invention provides a new fuel spillage control device construction wherein the same can be utilized for qualitatively determining the liquid level inside a fuel tank as it is being filled.

The general purpose of the present invention, which will be described subsequently in greater detail, is to provide a new fuel spillage control device and method for using same apparatus and method which has many of the advantages of the fuel spillage control devices mentioned heretofore and many novel features that result in a new fuel spillage control device and method for using same which is not anticipated, rendered obvious, suggested, or even implied by any of the prior art fuel spillage control devices, either alone or in any combination thereof.

To attain this, the present invention generally comprises a microphone for generating an audio signal, an amplifier means for amplifying the audio signal and a pair of ear phones for transducing the amplified audio signal.

There has thus been outlined) rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fuel spillage control device and method for using same apparatus and method which has many of the advantages of the fuel spillage control devices mentioned heretofore and many novel features that result in a new fuel spillage control device and method for using same which is not anticipated, rendered obvious, suggested, or even implied by any of the prior art fuel spillage control devices, either alone or in any combination thereof.

It is another object of the present invention to provide a new fuel spillage control device and method for using same which may be easily and efficiently manufactured and marketed.

It is a further object of the present invention to provide a new fuel spillage control device and method for using same which is of a durable and reliable construction.

An even further object of the present invention is to provide a new fuel spillage control device and method for using same which is susceptible of a low cost of manufacture with regard to both materials and labor, and which accordingly is then susceptible of low prices of sale to the consuming public, thereby making such fuel spillage control device and method for using same economically available to the buying public.

Still yet another object of the present invention is to provide a new fuel spillage control device and method for using same which provides in the apparatuses and methods of the prior art some of the advantages thereof, while simultaneously overcoming some of the disadvantages normally associated therewith.

Still another object of the present invention is to provide a new fuel spillage control device and method for using same for qualitatively determining the liquid level inside a fuel tank as it is being filled.

Yet another object of the present invention is to provide a new fuel spillage control device and method for using same which includes a microphone for generating an audio signal, an amplifier means for amplifying the audio signal and a pair of ear phones for transducing the amplified audio signal.

Still yet another object of the present invention is to provide a new fuel spillage control device and method for using same that reduces the risk of accidental spillage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of a microphone according to the present invention.

FIG. 6 is a perspective view of a carrying case.

DESCRIPTION OF THE PREFERRED EMBODIMENT

Figure 1:
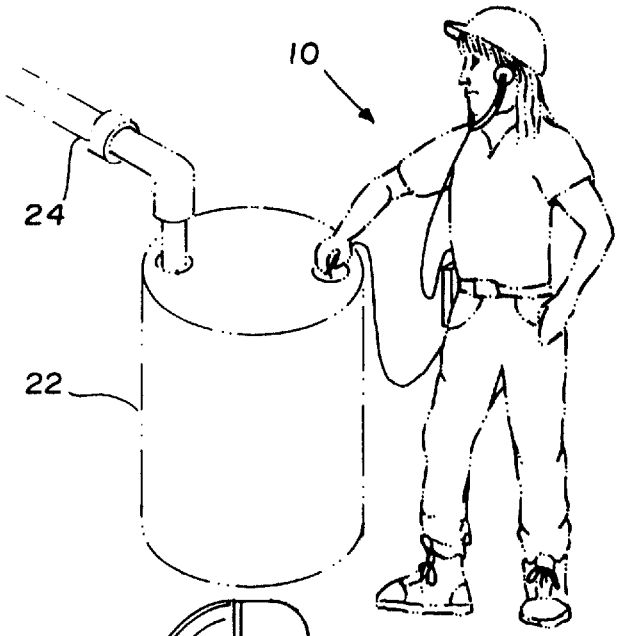
FIG. 1 is a view of a new fuel spillage control device according to the present invention being used by an operator.
Figure 2:
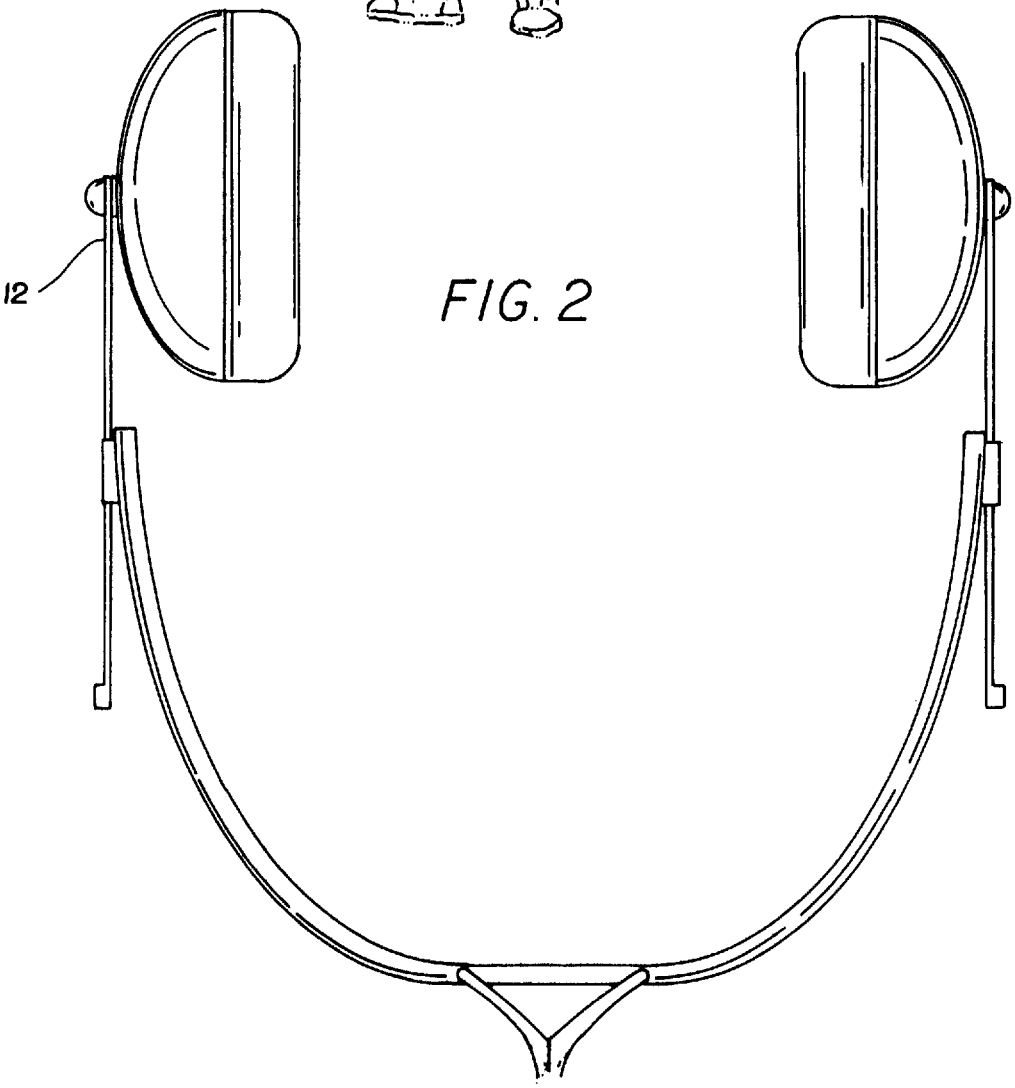
FIG. 2 is a plan view of a pair of ear phones thereof.
Figure 3:
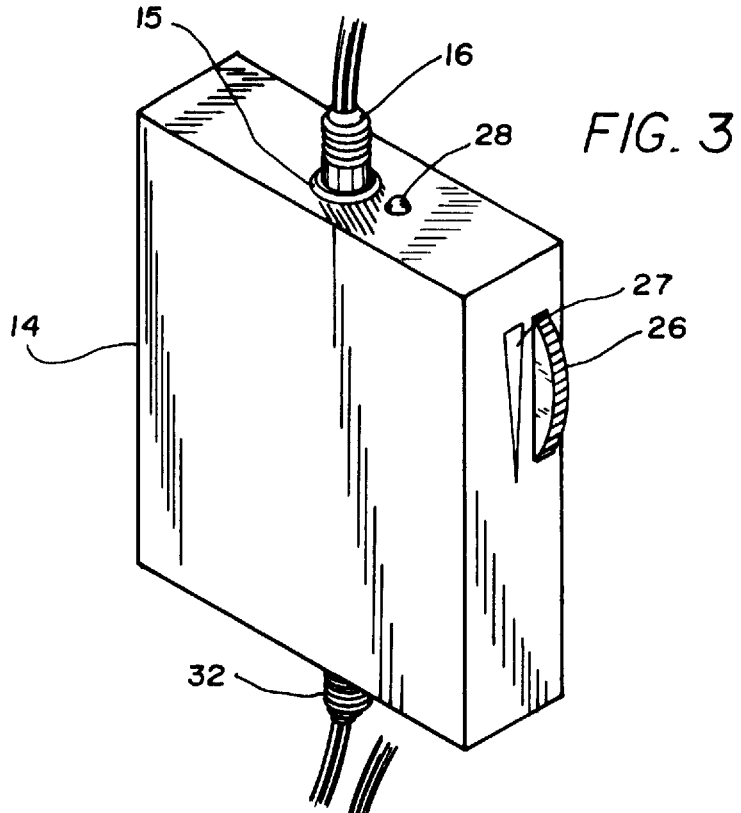
FIG. 3 is a front perspective view of the present invention.
Figure 4:
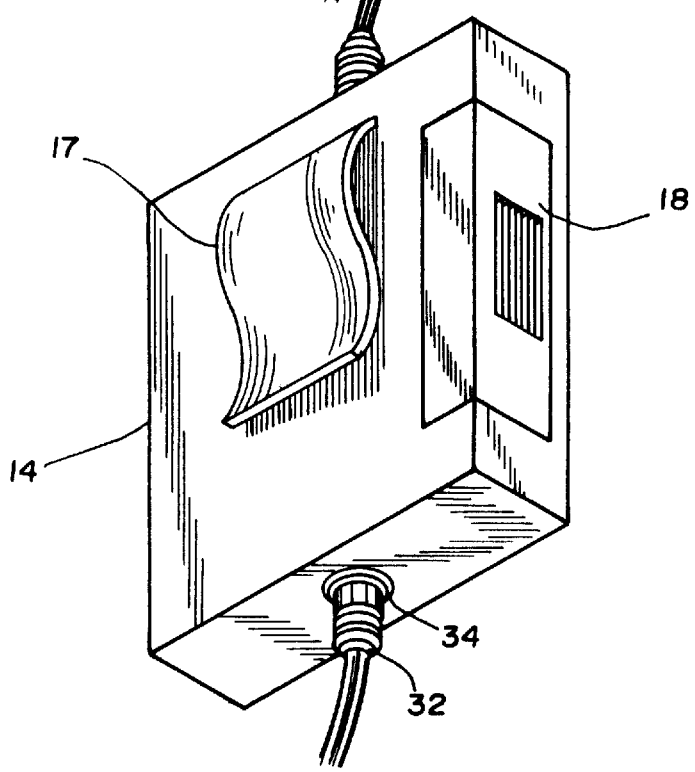
FIG. 4 is a rear perspective view of the invention.

With reference now to the drawings, and in particular to FIGS. 1 through 6 thereof, a new fuel spillage control device embodying the principles and concepts of the present invention and generally designated by the reference numeral 10 will be described.

More specifically, it will be noted that the fuel spillage control device 10 comprises a microphone 36 for generating an audio signal, an amplifier means for amplifying the audio signal (not shown) and a pair of ear phones 12 for transducing the amplified audio signal.

As best illustrated in FIGS. 1 through 6, it can be shown that an amplifier such as an audio amplifier well known in the art (not shown) is housed in housing 14. Housing 14 includes an ear phone output jack 15 for electrically coupling to ear phone plug 16. Housing 14 also includes a microphone input jack 34 for electrically coupling to microphone plug 32.

A belt clip 17 is fixedly attached to the housing 14 and is adapted to removably engage an operator's belt while the fuel spillage control device 10 is in use. A battery door 18 is provided for inserting and removing batteries (not shown) for powering the amplifier.

Additionally, a well known combination on/off and volume control switch 26 is provided for switching power to the fuel spillage control device 10 and regulating the volume of an amplified audio signal provided to the ear phones 12. An LED indicator 28 is also provided to alert the operator of the fuel spillage control device's status. Volume intensity direction indicator 27 is disposed proximate the on/off and volume control switch 26 to provide the operator with an indication of the direction of increasing volume intensity.

A storage and carrying case 42 is provided for use with the amplifier housing 14. The storage and carrying case 42 includes belt loops 44 for attaching the storage and carrying case 42 to the operator's belt and snap 46 for securing the housing 14 within the storage and carrying case 42.

To qualitatively determine the liquid level inside the fuel tank, after a fill hose 24 has been inserted into the fuel tank 22, an operator lowers the microphone into the fuel tank 22 to a distance above the liquid level, a valve to the fill hose is opened, thereby filling the fuel tank, an audio signal generated by the microphone 36 is amplified and the amplified audio signal is listened to by the operator through the ear phones 12 for changes in pitch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In combination, a fuel spillage control device; and a fuel container having a fill opening and an interior, wherein the fuel spillage control device comprises:

an insertion microphone positioned in the interior of said fuel container such that said microphone is capable of picking up audible sounds from within the interior of said fuel container and converting said audible sounds into an audio signal;

an amplifier means for amplifying the audio signal; and a pair of ear phones for transducing the amplified audio signal into an audible sound.

2. The combination of claim 1 wherein the amplifier means further comprises an audio amplifier having an on/off switch and a means for controlling the output of the audio amplifier.

3. The combination of claim 1 wherein the audio amplifier is housed in a housing, the housing having a belt clip fixedly attached thereto.

4. The combination of claim 3 further comprising a carrying case adapted to receive the housing.

5. The combination of claim 1, wherein each of said earphones includes a respective ear cover member, each said ear cover member being adapted for substantially covering an ear of a user of the devive whereby outside noise is muted.

6. A method of qualitatively determining the liquid level inside a fuel tank comprising the following steps in the order named:

inserting a fill hose into the fuel tank;

lowering a micrphone into the fuel tank to a distance above the liquid level;

opening a valve to the fill hose, thereby filling the fuel tank;

amplifying an audio signal generated by the microphone;

transducing an amplified output audio signal; and listening for changes in pitch.

7. A method of determining the liquid level inside a tank having a fill opening and an interior, said method comprising:

providing a spillage control device comprising an insertion microphone capable of picking up audible sounds and converting the audible sounds into an audile signal, an amplifier means for amplifying the audio signal, and an earphone for transducing the amplified audio signal into an audible sound for reception by an ear of a user of the spillage control device;

inserting a fill hose through the fill opening and into the interior of the tank;

lowering a microphone into the interior of the tank to a position above the liquid surface level;

opening a valve in communication with the fill hose to thereby pass liquid through the fill hose and into the interior of the tank;

amplifying the audio signal generated by the microphone and passing the amplified audio signal to the earphone for transducing into an audible sound; and listening for changes in pitch for determining the proximity of the liquid surface level in the interior of the tank to the fill opening of the tank.

8. In combination, a fuel spillage control device; and a fuel container having a fill opening and an interior, wherein the fuel spillage control device comprises:

an insertion microphone positioned in the interior of said fuel container such that said microphone is capable of picking up audible sounds from within the interior of said fuel container and coverting said audible sounds into an audio signal;

an amplifier means for amplifying the audio signal; and a pair of ear phones for transducing the amplified audio signal into an audible sound; and a carrying case adapted to receive the housing;

wherein the amplifier means further comprise an audio amplifier having an on/off switch and a means for controlling the output of the audio amplifier; and wherein the audio amplifier is housed in a housing, the housing having a belt clip fixedly attached thereto.

* * * * *